US005488448A

United States Patent [19]

Merle et al.

[11] Patent Number: 5,488,448

[45] Date of Patent: Jan. 30, 1996

[54] FILM CARTRIDGE RECOVERY TOOL

[75] Inventors: Thomas C. Merle; Dale W. Ryan, both of Rochester; Walter C. Slater, Prattsburg; David L. Rowden, Rochester; Gerald F. Sherman, Jr., LeRoy; Alfonso Ianni, Rochester, all of N.Y.

[73] Assignee: Eastman Kodak Company, Rochester, N.Y.

[21] Appl. No.: 336,599

[22] Filed: Nov. 9, 1994

[51] Int. Cl.[6] ..... G03D 17/00; G03D 13/14

[52] U.S. Cl. ..... 354/313; 354/340; 354/341

[58] Field of Search ..... 354/310, 313, 354/308, 275, 341, 340

[56] References Cited

U.S. PATENT DOCUMENTS 1,125,653 1/1915 Clark .
4,094,726 6/1978 Hujer et al. ..... 354/313 X
4,557,425 12/1985 Ichikawa ..... 354/313 X
4,799,076 1/1989 Zangenfeind et al. ..... 354/308
5,229,802 7/1993 Shiota et al. ..... 354/275
5,347,338 9/1994 Weibel ..... 354/340

*Primary Examiner*—D. Rutledge
*Attorney, Agent, or Firm*—Frank Pincelli

[57] ABSTRACT

A recovery tool for receiving film cartridges and for storing the cartridges in a predetermined sequence and a method of using same. The recovery tool comprising a generally tubular member having a receiving chamber designed to hold a plurality of film cartridges in a single column, one cartridge above the other. The chamber has an upper end and a lower end, and an inlet/outlet opening is provided at the upper end of the tubular member for allowing film cartridges to be inserted into or removed from the chamber. A movable member is provided for limiting the number of film cartridges that can be placed into the receiving chamber. A removal port is provided for allowing a film cartridge to be removed from the receiving chamber at a predetermined location.

30 Claims, 6 Drawing Sheets

FILM CARTRIDGE RECOVERY TOOL

FIELD OF THE INVENTION

The present invention relates to a tool for use in recovering or transporting film cartridges to and from a magazine, a photofinishing device, or other similar-type device.

BACKGROUND OF THE INVENTION

In copending application Ser. No. 08/336,455 (Attorney Docket 70,868), filed concurrently herewith of Gerald F. Sherman and Dale W. Ryan, entitled DUAL DISK SHUTTER MECHANISM, and Ser. No. 08/172,013, filed Dec. 22, 1993 of Dennis F. Tianello, Alfonso Ianni, John A. Romansky, Gerald F. Sherman, Jr., William T. Matthias and Ralph E. Williams, entitled FILM CARTRIDGE MAGAZINE, there is disclosed a film cartridge magazine having a plurality of retaining pockets arranged in a circular pattern about a magazine axis. The pockets are arranged in columns which allow for sequential placement of film cartridges thereon. The magazine can be used for transporting and presenting film cartridges in the photofinishing process. It is anticipated that in certain situations a particular film cartridge may present problems during the photofinishing process requiring removal of that particular film cartridge from the magazine, or that the photofinishing equipment operator may need to transfer the film cartridges from one magazine to another. Typically, the film cartridges are arranged in a predetermined sequence within the magazine. It is desirable to provide a tool whereby a particular trouble cartridge can be removed easily and quickly while maintaining sequence in the non-effected film cartridges which are returned to the magazine or other device from which it is removed.

The present invention discloses a method and tool for recovering a trouble cartridge from a magazine which is easy to use while maintaining the sequence of the cartridge being returned or transferred.

SUMMARY OF THE INVENTION

In one aspect of the present invention there is provided a recovery tool for receiving film cartridges and for storing the cartridges in a predetermined sequence. The recovery tool comprising a generally tubular member having a receiving chamber designed to hold a plurality of film cartridges in a single column, one cartridge above the other. The chamber has an upper end and a lower end, and an inlet/outlet opening is provided at the upper end of the tubular member for allowing film cartridges to be inserted into or removed from the chamber. A movable member is provided for limiting the number of film cartridges that can be placed into the receiving chamber.

In another aspect of the present invention there is provided a recovery tool for receiving film cartridges and for storing the cartridges in a predetermined sequence. The recovery tool comprises a generally tubular member having a receiving chamber designed to hold a plurality of film cartridges in a single column, one cartridge: above the other. The chamber has an upper end, a lower end, and a removal port for allowing a film cartridge to be removed from the receiving chamber at a predetermined location. An inlet/outlet opening is provided at the upper end of the tubular member for allowing film cartridges to be inserted into or removed from the chamber, and movable member is provided for limiting the number of film cartridges that can be placed into the receiving chambers.

In still another aspect of the present invention there is provided a method of recovering a troubled roll film cartridge in a magazine having a plurality of generally disk-shaped members, each disk-shaped member having a plurality of sleeves disposed about the circumference. The sleeves in each of the disk-shaped member are alignable with sleeves in the adjacent disk-shaped member so as to form a continuous axial passage through the magazine. The magazine has shutter mechanism for allowing insertion or removal of film cartridges from the aligned sleeves in the disks, the method comprising steps of;

providing a recovery tool for receiving film cartridges and for storing the cartridges in a predetermined sequence, the recovery tool comprising:

a generally tubular member having a receiving chamber designed to hold a plurality of film cartridges in a single column, one cartridge above the other, the chamber having an upper end and a lower end, an inlet/outlet opening is provided at the upper end of the tubular member for allowing the film cartridge to be inserted into or removed from the chamber, and a removal port for allowing removal a film cartridge at a predetermined location; and means for limiting the number of film cartridges that can be placed into the receiving chambers;

adjusting the position of the means for limiting the number of cartridges that can placed in the chamber such that the trouble roll cartridge will be located adjacent the removal port;

placing the recovery tool such that the inlet/outlet opening of the tool is positioned for receiving cartridges from the magazine;

dispensing cartridges from the magazine into the chamber;

removing the trouble film cartridge through the removal port; and reloading the remaining cartridges back into the magazine from the recovery tool.

In yet another aspect of the present invention there is provided a method of recovering a troubled roll film cartridge in the magazine having a plurality of generally disk-shaped members, each disk-shaped member having a plurality of sleeves disposed about the circumference, the sleeves in each of the disk-shaped member being alignable with sleeves in the adjacent disk-shaped member so as to form a continuous axial passage through the magazine, the magazine having means for allowing insertion or removal of film cartridges from the aligned sleeves in the disks, the method comprising steps of;

providing a recovery tool for receiving film cartridges and for storing the cartridges in a predetermined sequence, the recovery tool comprising:

a generally tubular member having a receiving chamber designed to hold a plurality of film cartridges in a single column, one cartridge above the other, the chamber having an upper end and a lower end, an inlet/outlet opening is provided at the upper end of the tubular member for allowing the film cartridge to be inserted into or removed from the chamber, and a removal port for allowing removal a film cartridge at a predetermined location; and a movable member for limiting the number of film cartridges that can be placed into the receiving chambers;

adjusting the means for limiting the number of film cartridges that can be placed in the chamber so that the desired cartridge to be removed is located adjacent the removal port;

placing the recovery tool such that the inlet/outlet of the opening of the tool is positioned for receiving cartridges from the magazine;

dispensing cartridges from the magazine into the chamber;

removing the trouble film cartridge through the removal port; and reloading the remaining cartridges back into the magazine from the recovery tool

DETAILED DESCRIPTION OF THE DRAWINGS

FIG. 7 is a perspective view of a magazine which the tool of the present invention may be used with.

DETAILED DESCRIPTION OF THE DRAWINGS

Figure 1:
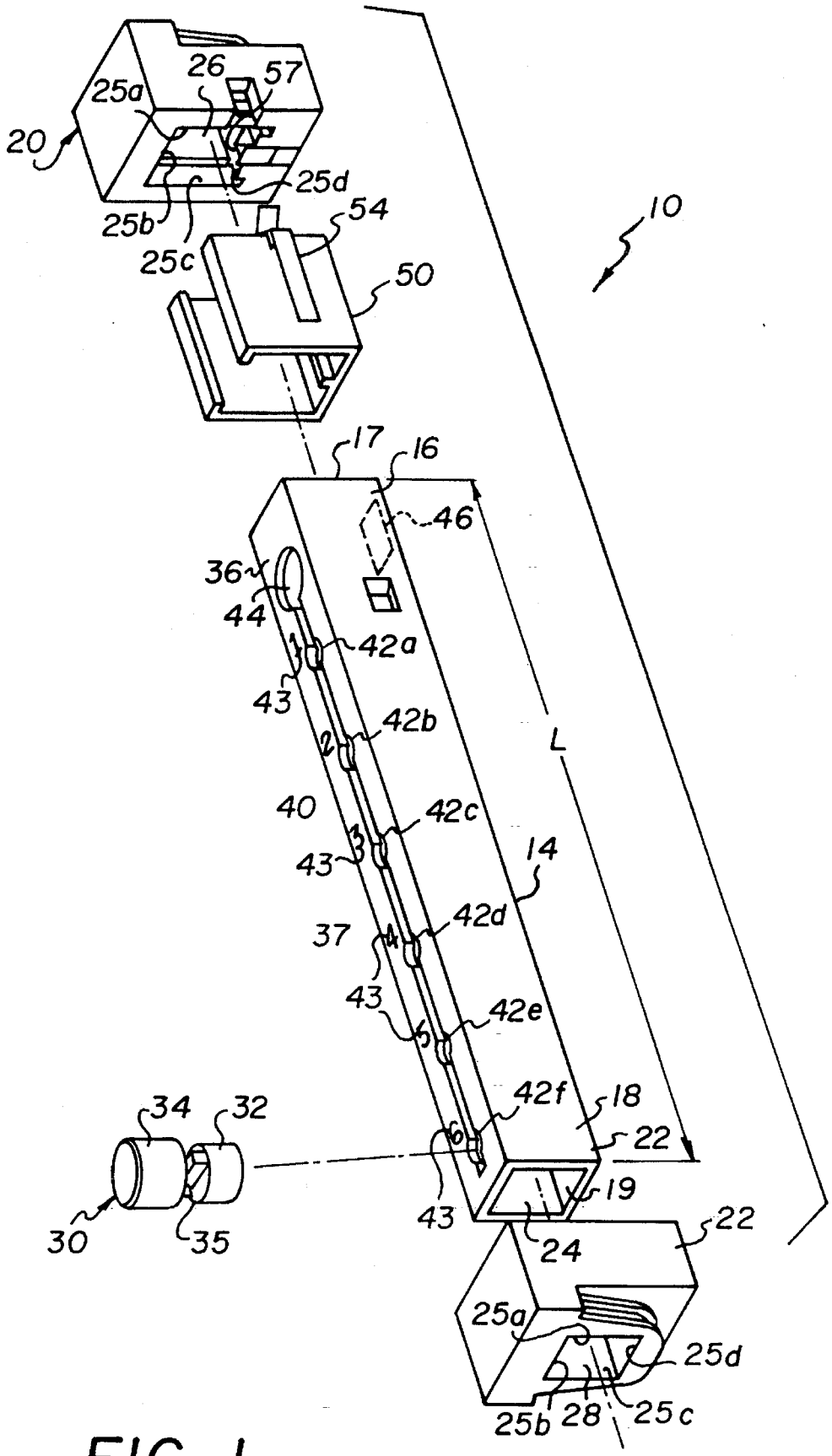
FIG. 1 is an exploded perspective view of a recovery tool made in accordance with the present invention.
Figure 2:
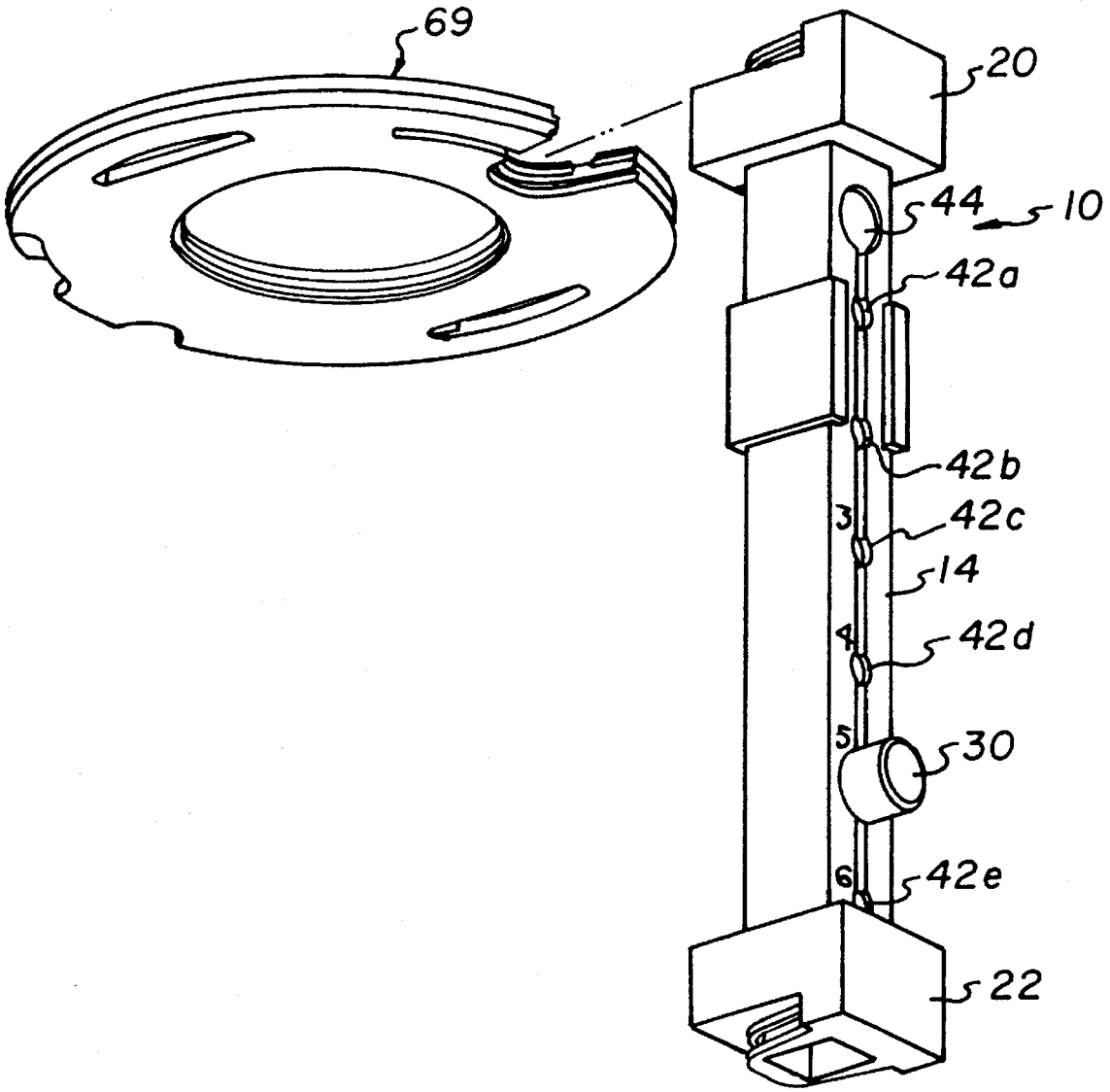
FIG. 2 is an assembled view of the tool of FIG. 1 as taken from a different line of sight, and a shutter mechanism which the tool is designed to engage.
Figure 3:
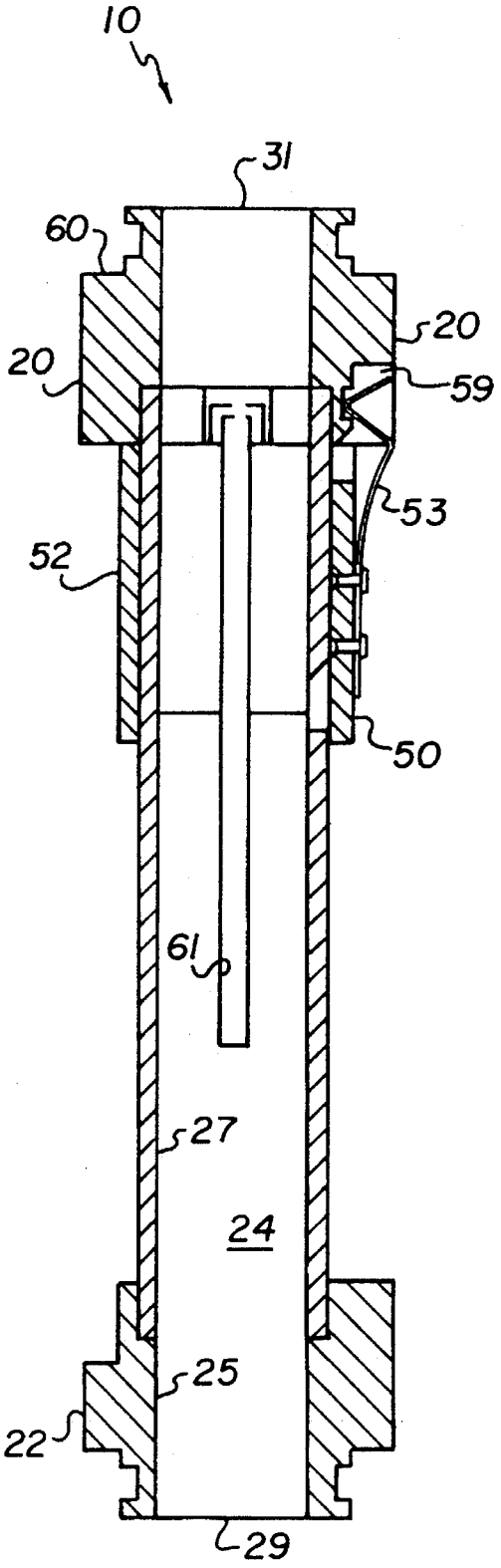
FIG. 3 is an enlarged cross-sectional view of the assembled tool of FIG. 1 as taken along line 3—3 of FIG. 2 illustrating the shutter assembly in a first position.
Figure 4:
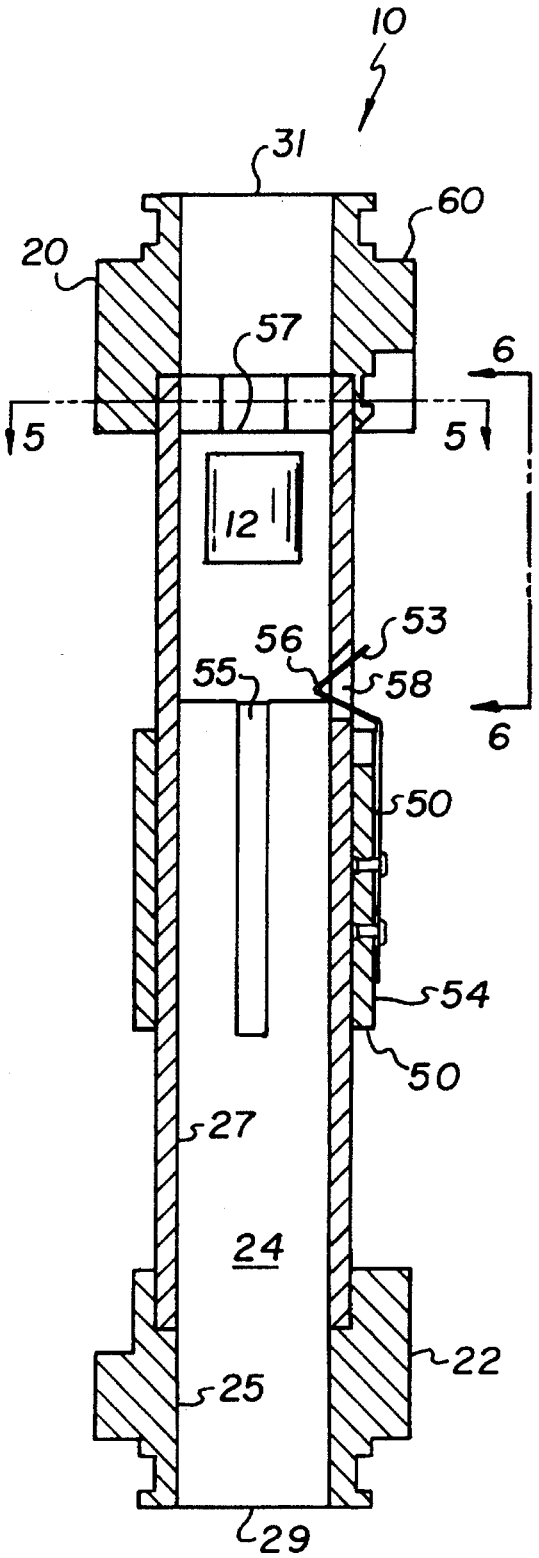
FIG. 4 is a view similar to FIG. 3 illustrating the shutter in the second position.
Figure 5:
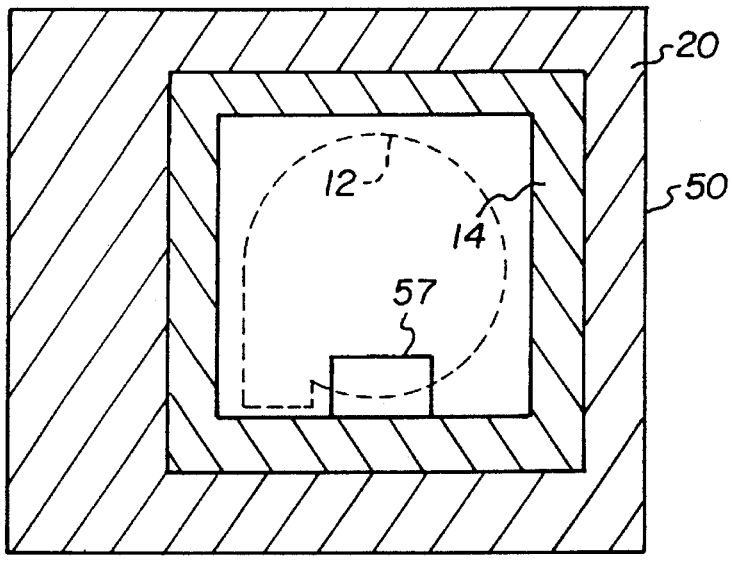
FIG. 5 is a cross-sectional view of the tool of FIG. 4 as taken along line 5—5 of FIG. 4.

Referring to FIGS. 1–5, there is illustrated a recovery tool 10 made in accordance with the present invention designed to receive film cartridges 12 (one of which is shown in FIG. 4) of the type which are well known to those in the art. For example, the film cartridge 12 could be a 35 mm film cartridge, such as a film cartridge sold by the Eastman Kodak Company. Recovery tool 10 includes a recovery tube 14 having an upper end 16 and lower end 18. Secured at the upper end 16 is an adapter member 20 designed for engagement with a magazine or other film cartridge holding device. Similarly, the lower end 18 is also provided with adapter member 22 also designed to engage a magazine designed to receive and hold film cartridges or other similar device. In the particular embodiment illustrated, the adapter members 20,22 are secured by an appropriate adhesive to the tube 14. However, the adapter members 20,22 may be secured in any desired fashion. The recovery tube 14 defines a chamber 24 designed to receive a plurality of film cartridges 12 in a single column such that the film cartridges 12 can be easily passed into or through the chamber 24. In the particular embodiment illustrated, the chamber 24 has a substantially rectangular cross-sectional configuration designed to hold the film cartridges, such that the axis of the film cartridges are substantially parallel to the axis of movement along the chamber 24. The adapter members 20,22 have internal walls 25*a*, 25*b*, 25*c*, 25*d* which defines internal passageways 26,28 which are in co-alignment and have substantially the same cross-sectional configuration as the surface 27 of chamber 24 thereby providing inlet/outlet openings 29,31 for allowing film cartridges to be inserted or removed from chamber 24. As illustrated in FIGS. 3 and 4, there is preferably provided a substantially continuous passageway from the top of the adapter 20 through chamber 24 to the bottom of adapter 22. Thus, minimizing any possibility of causing the cartridge 12 from being restricted within the tube 14 and is movable along the recovery tool.

The recovery tube 14 has a length L designed to receive a predetermined number of film cartridges. In the particular embodiment illustrated, the recovery tube has a length L such that six film cartridges 12 may be held within the chamber 24. The tube 14 and adapter members 20,22 may be made of any suitable material. In the embodiment illustrated, tube 14 and adapter members 20,22 are made of a suitable plastic material, such as polycarbonate. The tube 14, in the embodiment illustrated, is made of a visually transparent material, preferably of a clear plastic material, so as to allow easy inspection. Means are provided for limiting the number of film cartridges that may be inserted into and held within the chamber 24. In the particular embodiment illustrated, this is accomplished by providing a stop member 30 having an internal section 32, which is designed to be positioned within chamber 24, an outer section 34 designed to be positioned outside of chamber 24, and a connecting section 35 which extends through the side wall 37. Connecting section 35 extends through a substantially longitudinal opening/slot 40 provided in side 36 which allows the stop to travel along the length of tube 14. In the particular embodiment illustrated, a plurality of stop points 42*a*–*f* are provided whereby stop 30 can be located at each stop point. In the embodiment illustrated, stop points 42*a*–*f* are substantially circular openings which are slightly larger than the opening 40 such that when stop 30 is rotated approximately 90° the stop 30 will lock in position at one of the stop points and when rotated again approximately 90°, the stop 30 can easily slide along opening 40. The stop 30, when locked in place at one of the stop points 42*a*–*f*, will limit the number of film cartridges 12 that can be inserted through inlet 17 into chamber 24. In particular, internal section 32 is sized such that the cartridge can not pass by stop 30 in chamber 24. When the stop 30 is located at position 42*a*, a single film cartridge may be placed in chamber 24. When the stop 30 is located at position 42*b*, two film cartridges can be placed in chamber 24 and likewise to the remaining positions 42*c*–42*f*, allowing a total of six cartridges to be held within the tube 14. Indicia means are provided for indicating the number and positional sequence of film cartridges placed in chamber 24. In the embodiment illustrated, indicia means comprise integers 43, in particular, numbers "1", "2", "3", "4", "5", and "6". However, other symbols or letters may be used, such as Roman numerals, Greek letters, Arabic letters, etc. When the stop 30 is removed, film cartridge 12 may pass through the recovery tube 14. At the upper end of opening 40 there is provided an access opening 44 which is designed to allow the stop 30 to be inserted or removed from slot 40. Access opening 44 is disposed opposite exit port 46 so to also allow access to the trouble roll disposed opposite an exit port 46 when removing the film cartridge from the tool 10. The exit port 46 is sized so as to allow a film cartridge to be easily removed from tube 14.

Figure 6:
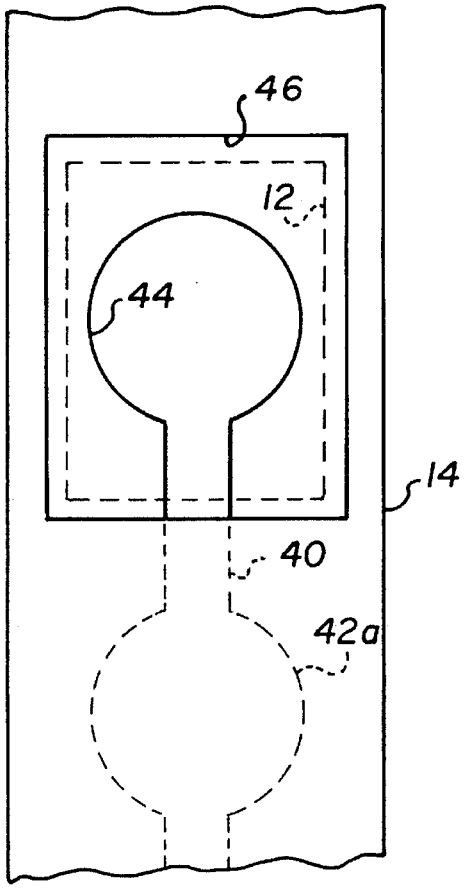
FIG. 6 is a side elevational view of the tool as taken along line 6—6 of FIG. 4.

A shutter 50 is slideably mounted to tube 14 for slideable movement between a first position 52, shown in FIG. 3, and a second position 54, illustrated in FIG. 4. The shutter 50, when in the first position 52, covers exit port 46 (see FIG. 6), thus preventing the removal of a cartridge 12 located at the top of tube 14. However, when the shutter 50 is in the second position 54, the exit port 46 is no longer blocked by the shutter 50, thus allowing the removal of a trouble roll cartridge 12 (as indicated by dash lines in FIG. 6) located adjacent the exit port 46. Means are provided for locking the shutter 50 in the first position 52 or second position 54. In the particular embodiment illustrated, this is accomplished by providing a spring member 53 secured to the shutter 50 having a projecting portion 56 which engages an recess 58 provided in tube 14 when the shutter is placed in the second position, or a recess 59 provided on the exterior of adapter 20 when in the first position. The spring member 53 is designed so as to provide a sufficient amount of force to retain the shutter 50 in the first or second position, but is sufficiently small such that the shutter 50 can be easily moved between position 52 and 54. The shutter 50 is moved between the first and second positions by simply sliding the shutter 50 along the tube 14.

The shutter 50 is also provided with a projection 55 designed to engage a flexible retaining spring 57 provided in tool 10. Spring 57 prevents film cartridges 12 from either entering or leaving the chamber 24 of tool 10. The projection 55 slides within slot 61 provided in tube 14. The projection 55, preferably as illustrated, does not extend into chamber 24. When the shutter 50 is in the first position, (as shown in FIG. 3) projection 55 deforms the retaining spring 57 so as to allow clear access to chamber 24 for cartridges to enter or leave. However, as illustrated in FIG. 4, when the shutter is in the second position, the spring 57 extends outward which prevents cartridges from passing into or out of chamber 24.

Figure 7:
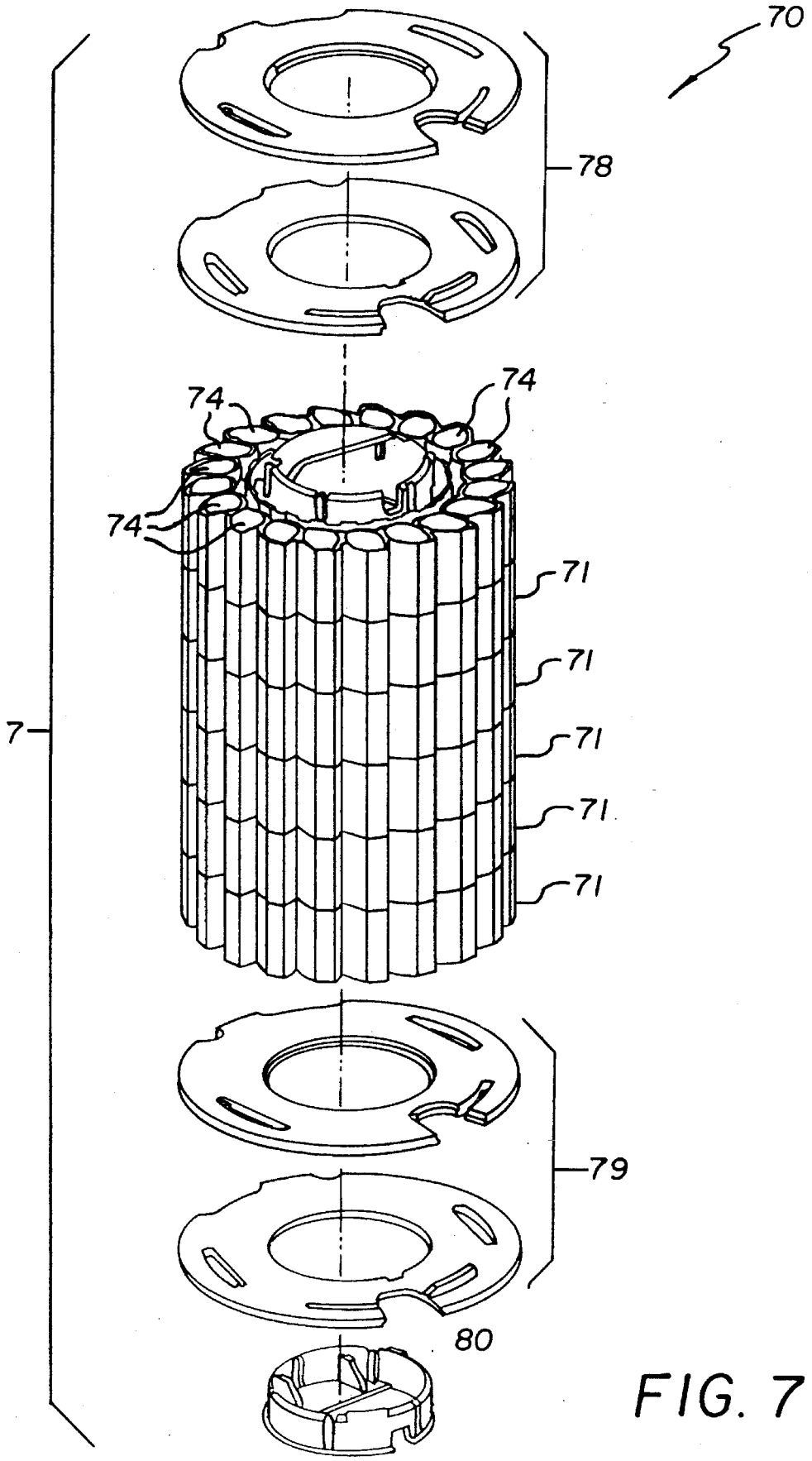
Figure 8:
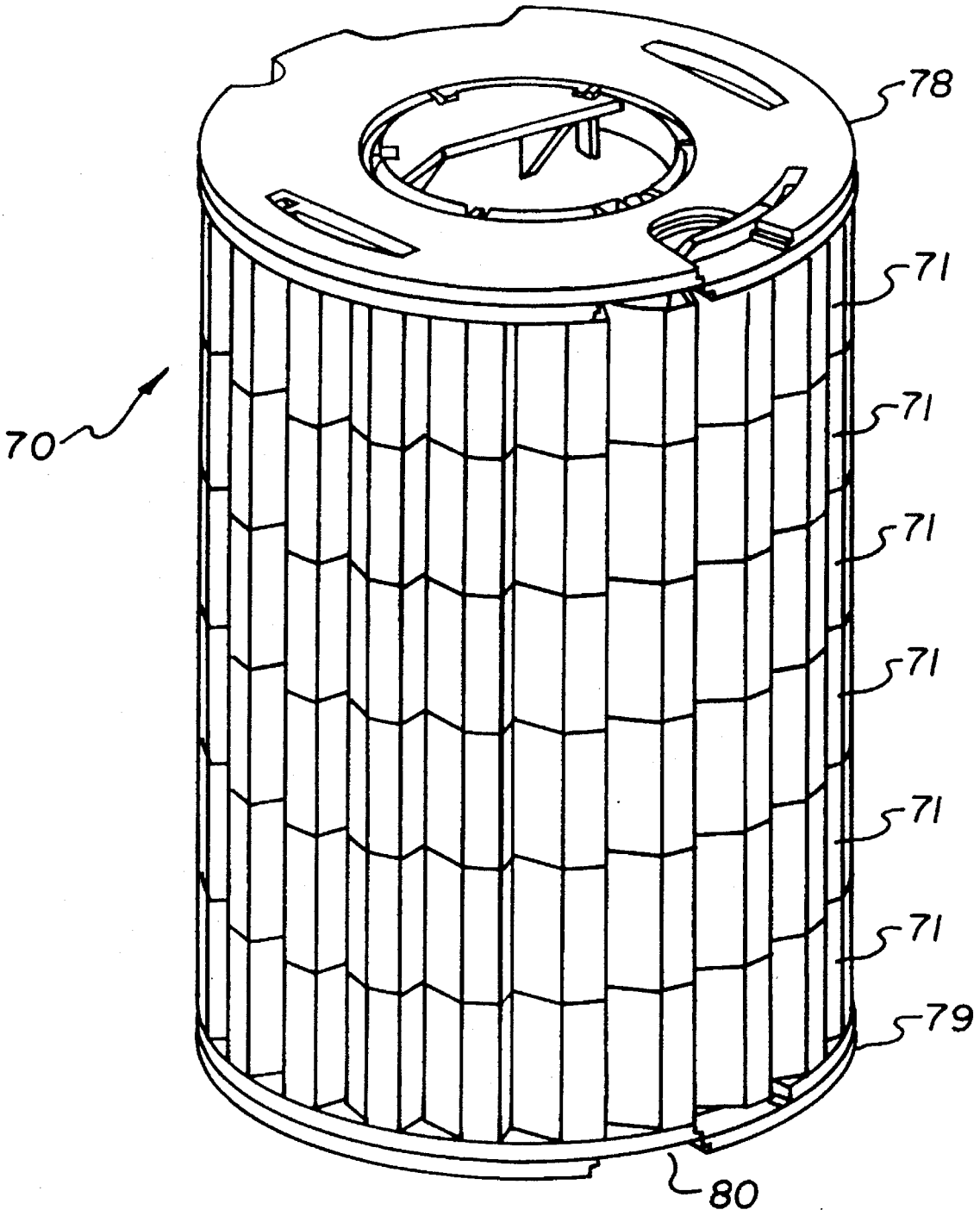
FIG. 8 is a perspective view of the assembled magazine of Figure. 7.

In the preferred embodiment, the adapter member 20 has a registration surface 60 designed to engage a magazine or other device wherein cartridges 12 are stored. As illustrated in FIG. 4, the adapter 20 is designed to engage the shutter mechanism 79 of a magazine 70. An example of a magazine 70 suitable for use in the present invention is described in greater detail in copending applications Ser. No. 08/336,455 (Attorney Docket 70,868), filed concurrently herewith of Gerald F. Sherman and Dale W. Ryan, entitled DUAL DISK SHUTTER MECHANISM, and Ser. No. 08/172,013, filed Dec. 22, 1993 of Dennis F. Tianello, Alfonso Ianni, John A. Romansky, Gerald F. Sherman, Jr., William T. Matthias and Ralph E. Williams, entitled FILM CARTRIDGE MAGAZINE, both of which are hereby incorporated by reference in their entirety. It is to be understood that the tool 10 may be designed to engage any other magazine or device desired by designing adapter 20 to be appropriately configured for proper engagement. As illustrated in FIGS. 7 and 8, the magazine 70 has a plurality of generally disk-shaped retaining member 71. Each disk member 71 having a plurality of sleeves 74 disposed about the circumference of the member 71 being in axial alignment with the sleeves 74 of the adjacent member 71 so that an axial passage 73 is formed for allowing cartridges to slide through. Shutter assemblies 78,79 are provided at each end, each having an outlet for allowing insertion or removal of film cartridges from the magazine 70. If it is desired to remove the middle cartridge from the magazine, i.e., in row 72, which is the third cartridge in the column, the recovery tool 10 would be positioned so as to engage the opening 80 of the lower shutter mechanism 79 allowing the cartridges to pass into chamber 24. When the stop 30 is placed at the 42*c* position, only three film cartridges would be allowed to enter tube 14, thus the remaining cartridges would not be dispensed from the magazine 70.

In order to more clearly understand the present invention, a brief description as to the use and operation of the tool follows. If it is desired to remove a troubled roll cartridge from a magazine 70 containing a troubled cartridge, the magazine 70 is operated such that the troubled roll cartridge to be removed is in alignment with the dispensing opening 80 of the lower shutter mechanism 79 of magazine 70. The tool 10 is then placed into position such that the adapter member 20 properly engages the opening 80 in the magazine. The shutter 50 is moved into the first position whereby the spring member engages recess 59, locking the shutter 50 in position so that projection 55 deflects spring 57. The stop 30 is put into the desired position such that the troubled roll will be in the troubled roll position adjacent exit port 46. Thus, for example, if the film cartridge to be to be removed from the magazine is in the second position, the stop would be put at 42*b*. If the troubled roll cartridge is at the very top of the magazine, which is the fifth position in the particular embodiment illustrated, the stop 30 would be put at 42*e*, allowing five cartridges to be inserted into the chamber 24. Once the desired number of cartridges have been placed within the chamber 24, the shutter 50 is moved to the second position. The trouble roll cartridge is then removed from the recovery tube 14. This can be simply accomplished by inserting a finger and pushing the cartridge 12 out the exit port 46. After the troubled roll cartridge 12 has been removed, the shutter 50 is then moved to the first position thereby covering the exit port 46. Thereafter, the remaining cartridge 12 can be returned through opening 77 to the magazine. If desired, a blank cartridge may be placed into the recovery tube 14 so that the original cartridges are returned to the exact location in the magazine from where they came. Thereafter, the recovery tool 10 is removed.

Optionally, the recovery tool 10 can be used to simply transport cartridges from one magazine to another. In which case, the stop is removed entirely from the tube, allowing free access through the tool. The tool could engage a first magazine or device at adapter 20 and a second magazine or device at adapter 22 allowing direct transfer of cartridges from one device to a second.

The present invention provides a tool and method for recovering a trouble roll cartridge from a magazine or photofinishing device which can return the non-affected cartridge back: in the same sequence they were removed.

It is to be understood that various changes and modifications may be made without departing from the scope of the present invention. The present invention being limited by the following claims.

Parts List

10 . . . recovery tool
12 . . . cartridges
14 . . . recovery tube
16 . . . upper end
17 . . . inlet
18 . . . lower end
20,22 . . . adapter member
24 . . . chamber
25*a–d*. . . internal walls
26,28 . . . internal passageways
27 . . . surface
29,31 . . . openings
30 . . . stop member
32 . . . internal section
34 . . . outer section
35 . . . connecting section
36 . . . side
37 . . . side wall
38 . . . connecting section
40 . . . longitudinal opening/slot 42*a–f*. . . stop points
43 . . . integers
44 . . . access opening
46 . . . exit port
50 . . . shutter
52 . . . first position
53 . . . spring member
54 . . . second position
55 . . . projection
56 . . . projecting portion
57 . . . retaining spring
58,59 . . . recess
60 . . . registration surface
61 . . . slot
70 . . . magazine
71 . . . retaining member
72 . . . row
73 . . . axial passage
74 . . . sleeves
77 . . . opening
78,79 . . . shutter assemblies
80 . . . opening

We claim:

1. A recovery tool for receiving film cartridges and for storing said cartridges in a predetermined sequence, said recovery tool comprising:

a generally tubular member having a receiving chamber designed to hold a plurality of film cartridges in a single column, one cartridge above the other, said chamber having an upper end and a lower end, an inlet/outlet opening is provided at the upper end of said tubular member for allowing film cartridges to be inserted into or removed from said chamber; and means for limiting the number of film cartridges that can be placed into said receiving chamber.

2. A tool according to claim 1 further comprising indicia means associated with said means for limiting the number of cartridges placed into said chamber which identifies the number of cartridges and/or positional sequence of the cartridges placed in said chamber.

3. A recovery tool according to claim 1 wherein said means for limiting the number of cartridges that can be placed into said chamber comprises a plurality of openings disposed in the side of said tubular member which extend into said chamber, and a pin for placement at any one of said openings which limits the number of film cartridges that can be placed into said receiving chamber, said openings being spaced apart so as to correspond to the number of cartridges that can be placed into said chamber.

4. A recovery tool according to claim 3 wherein said indicia means associated with said means for limiting the number of cartridges that can be placed into said receiving chamber comprises numbers placed adjacent each of said openings that extend into said chamber, said numbers being indicative of the number of cartridges that can be held by said recovery tool when the pin is placed into said opening.

5. A recovery tool according to claim 1 having means for positioning of said inlet/outlet opening with respect to a device for dispensing cartridges in to said chamber.

6. A recovery tool according to claim 5 wherein said means for positioning of said inlet/outlet opening with respect to a device for dispensing cartridges thereto comprises an interface member secured to said tubular member, said interface member having a bearing surface designed to engage and mate with a registration surface provided on the dispensing device which dispenses said film cartridges.

7. A recovery tool according to claim 1 wherein said tubular member further comprises a removal port for allowing a film cartridge to be removed from said receiving chamber at a predetermined location and a movable shutter covering movable between a first position and a second position, said shutter when in said first position covers said removal port and when in the said second position allows removal of said cartridge through said removal port.

8. A recovery tool according to claim 7 wherein a retaining member is provided for retaining said shutter in said first or second positions.

9. A recovery tool according to claim 1 where the lower end of said chamber having an outlet for allowing film cartridges in said chamber to be removed therefrom.

10. A recovery tool according to claim 1 wherein said tubular member is made of a visually transparent material.

11. A film transport and recovery system comprising:

a magazine comprising a plurality of generally disk-shaped retaining members, each disk member having a plurality of sleeves disposed about the circumference of the disk and being in axial alignment with the sleeves in the adjacent disk;

a recovery tool for receiving film cartridges and for storing said cartridges in a predetermined sequence, said recovery tool comprising:

a generally tubular member having a receiving chamber designed to hold a plurality of film cartridges in a single column, one cartridge above the other, said chamber having an upper end and a lower end, an inlet/outlet opening is provided at the upper end of said tubular member for allowing film cartridges to be inserted into or removed from said chamber; and means for limiting the number of film cartridges that can be placed into said receiving chambers.

12. A film transport system according to claim 11 further comprising indicia means associated with said means for limiting the number of cartridges placed into said chamber for identifying the number of cartridges and/or position sequence of the cartridges placed therein.

13. A film transport system according to claim 11 wherein an opening is provided at the lower end of the chamber for allowing removal of film cartridges from said chamber.

14. A film transport system according to claim 11 further comprising a removal port for removing a single film cartridge from said chamber at a predetermined location.

15. A tool according to claim 14 further comprising a movable shutter movable between a first position and a second position, said shutter when in said first position covers said removal port and when in the said position allows removal of said cartridge through said removal port.

16. A recovery tool for receiving film cartridges and for storing said cartridges in a predetermined sequence, said recovery tool comprising:

a generally tubular member having a receiving chamber designed to hold a plurality of film cartridges in a single column, one cartridge above the other, said chamber having an upper end and a lower end, said tubular member having a removal port for allowing a film cartridge to be removed from said receiving chamber at a predetermined location, an inlet/outlet opening is provided at the upper end of said tubular member for allowing film cartridges to be inserted into or removed from said chamber; and means for limiting the number of film cartridges that can be placed into said receiving chamber.

17. A tool according to claim 16 further comprising a movable shutter movable between a first position and a second position, said shutter when in said first position covers said removal port and when in the said position allows removal of said cartridge through said removal port.

18. A tool according to claim 16 wherein an access port is provided so as to as in removal of a film cartridge from the chamber through said removal port.

19. A tool according to claim 18 wherein said access port is disposed opposite said removal port.

20. A tool according to claim 16 further comprising indicia means associated with said means for limiting the number of cartridges placed into said chamber which identifies the number of cartridges and/or positional sequence of the cartridges placed in said chamber.

21. A recovery tool according to claim 16 wherein said means for limiting the number of cartridges that can be placed into said chamber comprises a plurality of openings disposed in the side of said tubular member which extend into said chamber, and a pin for placement at any one of said openings which limits the number of film cartridges that can be placed into said receiving chamber, said openings being spaced apart so as to correspond to even integers of the number of cartridges that can be placed into said chamber.

22. A recovery tool according to claim 21 wherein said indicia means associated with said means for limiting the number of cartridges that can be placed into said receiving chamber comprises numbers placed adjacent each of said openings that extend into said chamber, said numbers being indicative of the number of cartridges that can be held by said recovery tool when the pin is placed into said opening.

23. A recovery tool according to claim 16 having means for positioning of said inlet/outlet opening with respect to a device for dispensing cartridges in to said chamber.

24. A recovery tool according to claim 23 wherein said means for positioning of said inlet/outlet opening with respect to a device for dispensing cartridges thereto comprises an interface member secured to said tubular member, said interface member having a bearing surface designed to engage and mate with a registration surface provided on the dispensing device which dispenses said film cartridges.

25. A recovery tool according to claim 17 wherein a retaining member is provided for retaining said shutter in said first or second positions.

26. A recovery tool according to claim 16 wherein said tubular member is made of a visually transparent material so that cartridges in said chamber can be inspected.

27. A method of recovering a troubled roll film cartridge in the magazine having a plurality of generally disk-shaped members, each disk-shaped member having a plurality of sleeves disposed about said circumference, said sleeves in each of said disk-shaped member being alignable with sleeves in the adjacent disk-shaped member so as to form a continuous axial passage through the magazine, said magazine having means for allowing insertion or removal of film cartridges from said aligned sleeves in said disks, said method comprising steps of;

providing a recovery tool for receiving film cartridges and for storing said cartridges in a predetermined sequence, said recovery tool comprising:

a generally tubular member having a receiving chamber designed to hold a plurality of film cartridges in a single column, one cartridge above the other, said chamber having an upper end and a lower end, an inlet/outlet opening is provided at the upper end of said tubular member for allowing film cartridges to be inserted into or removed from said chamber, and a removal port for allowing removal a film cartridge disposed at a predetermined location; and means for limiting the number of film cartridges that can be placed into said receiving chambers;

adjusting the position of the means for limiting the number of cartridges that can placed in said chamber such that the trouble roll cartridge will be located adjacent the removal port;

placing the recovery tool such that the inlet/outlet of the opening of said tool is positioned for receiving cartridges from said magazine;

dispensing cartridges from the magazine into the chamber of said tool;

removing the trouble film cartridge through said removal port; and reloading the remaining cartridges back into said magazine from said recovery tool.

28. A method of recovering a troubled roll film cartridge in the magazine having a plurality of generally disk-shaped members, each disk-shaped member having a plurality of sleeves disposed about said circumference, said sleeves in each of said disk-shaped member being alignable with sleeves in the adjacent disk-shaped member so as to form a continuous axial passage through the magazine, said magazine having means for allowing insertion or removal of film cartridges from said aligned sleeves in said disks, said method comprising steps of;

providing a recovery tool for receiving film cartridges and for storing said cartridges in a predetermined sequence, said recovery tool comprising:

a generally tubular member having a receiving chamber designed to hold a plurality of film cartridges in a single column, one cartridge above the other, said chamber having an upper and lower end, an inlet/outlet opening is provided at the upper end of said tubular member for allowing the film cartridge to be inserted into or removed from said chamber, and a removal port for allowing removal a film cartridge at a predetermined location; and means for limiting the number of film cartridges that can be placed into said receiving chambers;

adjusting the means for limiting the number of cartridges that can be placed in said chamber so that the desired cartridge to be removed is located adjacent the removal port;

placing the recovery tool such that the inlet/outlet of the opening of said tool is positioned for receiving cartridges from said magazine;

dispensing cartridges from the magazine into the chamber of said tool;

removing the trouble film cartridge through said removal port; and reloading the remaining cartridges back into said magazine from said recovery tool

29. A method according to claim 28 wherein said tubular member further comprises a predetermined location and a movable shutter covering movable between a first position and a second position, said shutter when in said first position covers said removal port and when in the said second position allows removal of said cartridge through said removal port, said method further comprising the steps of:

maintaining the shutter in the first position when cartridges are being inserted into said chamber;

moving the shutter to the second after the cartridges have been inserted into said chamber;

removing the troubled cartridge from the tool through said removal port; and returning the shutter to the first position.

30. The method according to claim 29 wherein said chamber is provided with an outlet at the lower end for allowing cartridges to be removed, said method further comprising the step of returning the remaining cartridge to the magazine through the outlet at the lower end of said chamber.

* * * * *